United States Patent [19]

Arabian

[11] 4,349,131

[45] Sep. 14, 1982

[54] APPARATUS FOR DOSING AND FORMING SOAP FOAM

[75] Inventor: Sandro Arabian, Vaduz, Liechtenstein

[73] Assignee: Europtool Trust, Vaduz, Liechtenstein

[21] Appl. No.: 142,003

[22] Filed: Apr. 21, 1980

[30] Foreign Application Priority Data

May 10, 1979 [CH] Switzerland ..... 4367/79

[51] Int. Cl.[3] ..... B67D 5/42; B67D 5/62

[52] U.S. Cl. ..... 222/135; 222/146 HE; 222/179; 222/185; 222/383; 239/135; 239/350

[58] Field of Search ..... 222/135, 145, 146 H, 222/146 HE, 179, 181, 185, 190, 383, 399; 239/135, 337, 338, 343, 350, 578

[56] References Cited

U.S. PATENT DOCUMENTS

| | | | |
|---|---|---|---|
| 1,219,364 | 3/1917 | Wise | 222/179 X |
| 1,736,392 | 11/1929 | Coss et al. | 222/179 X |
| 2,529,365 | 11/1950 | Barksdale | 222/185 |
| 2,715,045 | 8/1955 | Thompson | 239/343 |
| 2,772,029 | 11/1956 | De Lucia | 222/179 |
| 2,871,058 | 1/1959 | Puglia . | |
| 3,250,438 | 5/1966 | Packwood . | |
| 3,712,512 | 1/1973 | Snider, Jr. et al. | 222/67 |

FOREIGN PATENT DOCUMENTS

| | | | |
|---|---|---|---|
| 193523 | 2/1923 | United Kingdom . | |
| 201577 | 5/1924 | United Kingdom | 239/343 |

*Primary Examiner*—Gil Weidenfeld
*Assistant Examiner*—Fred A. Silverberg
*Attorney, Agent, or Firm*—Werner W. Kleeman

[57] ABSTRACT

An apparatus for forming lather or soap foam for washing and/or shaving purposes comprises an actuation lever which simultaneously serves to drive a piston, a liquid soap-dosing pump and a membrane pump for generating compressed air. A perforated wall of a conduit or line enables blowing the compressed air into a dosed quantity of liquid soap located within a mixing chamber, to thereby form a coarse bubble lather or soap foam which subsequently is blown through a porous body, homogenized and compacted. Different embodiments of the apparatus can be realized and it is particularly suitable for use as a foot actuated structure and for producing hot lather for shaving. A preferred construction contains an intermittently operated heater for preheating the compressed air, to thereby accomplish a particularly effective generation of hot lather. The apparatus has the advantage of increased economy owing to its reduced consumption of liquid soap and can be faultlessly hygienically operated and is especially environmentally protective.

25 Claims, 8 Drawing Figures

APPARATUS FOR DOSING AND FORMING SOAP FOAM

BACKGROUND OF THE INVENTION

The present invention relates to a new and improved construction of apparatus for producing soap foam or lather.

Generally speaking, the lather producing apparatus of the present development is of the type comprising a liquid soap-dosing device which can be activated by a lever and further contains therein a source of pressurized gas or air, which opens by means of closable orifices or openings and/or lines or conduits into a mixing chamber. The lather producing apparatus is equipped with at least one supply container or reservoir for an aqueous soap solution or liquid soap. Moreover, the lather producing apparatus can contain a heater device for producing warm lather or soap foam.

As is well known, soap dispensers of the most different designs are employed in public and private washrooms, toilets and the like. Among these there are known lather producing soap dispensers employing a propellant gas composed of dichlorodifluoromethane (more commonly known under the trademark "FREON 12") and the widespread use thereof has been restricted because of environmental reasons.

A lather producing apparatus according to the general type herein above described, is known to the art from U.S. Pat. No. 3,712,512, granted Jan. 23, 1973, wherein, with the aid of an exchangeable pressurized gas flask (not air) there is produced, by means of liquid soap a coarse bubble foam or lather, within a mixing chamber or compartment which is controlled by a float valve. By activating a lever for a random length of time and which is mounted at an end thereof and connected with a valve, the lather or soap foam flows, in a corresponding quantity, initially through a perforated plate arranged forwardly of the valve. This perforated plate reduces the size of the bubbles and increases the lather or foam density. Thereafter, the soap foam or lather flows through an outlet nozzle. This outlet nozzle has arranged forwardly thereof an electrical heating device enabling heating-up of the outflowing lather.

This prior art lather producing apparatus requires a large amount of space, and furthermore, the pressurized gas container or flask, must be regularly exchanged.

SUMMARY OF THE INVENTION

Therefore, with the foregoing in mind it is a primary object of the present invention to provide a new and improved construction of apparatus for dosing and producing lather or soap foam which is not associated with the aforementioned drawbacks and limitations of the prior art proposals discussed above.

Another and more specific object of the present invention aims at providing a new and improved construction of lather producing apparatus which is environmentally protective, has only modest spatial requirements, can be employed in a number of different ways and does not require any exchange of an exchangeable pressurized or compressed gas source.

Now in order to implement these and still further objects of the invention, which will become more readily apparent as the description proceeds, the invention contemplates that the actuation lever is simultaneously provided for the drive of a piston arranged in a cylinder compartment or chamber of the liquid soap-dosing or dispensing pump and for the compression and infeed of the pressurized gas or the pressurized air.

When the lather producing apparatus of the invention is provided with a heater or heating device, then it can be beneficially employed for producing warm or hot lather and particularly can be employed during shaving.

According to a further feature of the invention, the piston is constructed as a slide for closing and opening of the infeed means for the liquid soap to the cylinder compartment and for closing and opening a connection opening between the cylinder compartment and the mixing chamber. With this design it is possible to limit in portions the maximum dosed quantity. There is beneficially possible a reproducible quantity of produced foam, following each lever actuation, and independently of the actuation speed of the lever.

The compressed air source can be designed as a membrane pump. With this construction there is realized a particularly simple and maintenance-free or low maintenance compressed air source.

It is also possible for the lather producing apparatus to be designed such that the axis of the membrane pump extends perpendicular to the axis of the piston or, as the case may be, to a line parallel to the axis of the piston of the liquid soap-dosing pump. This affords an exceedingly space saving construction and produces a kinematically favorable movement course in the drive mechanism of both pumps.

When the membrane pump is equipped with a return spring, there is beneficially realized the result that the return movement, and thus, the pressure formation with the resultant production of lather, is accomplished by the return spring, and therefore is constant and independent of the activity of the user or operator of the equipment.

The dimension of the cylinder of the membrane pump and the stroke of the membrane piston is dimensioned in relation to a given dosing volume. Hence, there is realized the advantage that there prevails a particularly favorable volume ratio between the liquid soap and air, amounting to approximately 1:15.

The cylinder compartment is designed to have a dead space or region, possessing a blind hole space or chamber for an air cushion. Hence, there is provided a gas spring for the liquid soap and the same produces a rapid outflow of the liquid soap from the dosing device into the mixing chamber.

According to a further facet of the invention the inlet opening or line opens into the lower portion of the mixing chamber or compartment. In this way the inlet opening or line immerses into the dosed liquid soap, advantageously thereby producing an intensified formation of bubbles.

The wall of the inlet opening or line can be perforated, which, in turn, affords the benefit that there are produced a large number of smaller bubbles.

It is also possible to arrange a porous body between the mixing chamber and the outlet opening for the lather or soap foam. With this construction the bubbles are transformed into a homogeneous lather of high density.

Between the porous body and the outlet opening there can be provided an expansion chamber. The lather which flows through the porous body is allowed to freely expand, so that even during a subsequent renewed compaction to a smaller outflow cross-sectional area, there is realized a uniform high lather quality.

The expansion chamber or compartment can be contained within an exchangeable foam deflection body. This affords advantages in terms of fabrication and also in terms of equipment maintenance.

The actuation lever may be designed as a double-arm lever, whereby there is realized the benefit of a multifarious use of the equipment and there are needed only low actuation forces. The lever arm for the actuation of the membrane or diaphragm pump equipped with spring means, is longer than the lever arm used for the drive of the piston of the liquid soap-dosing pump. This is associated with the advantage that the force applied during actuation is predominantly available for the subsequent compression of the air in the membrane pump.

When the actuation lever possesses a hand grip then the lather producing apparatus can be advantageously employed in the private sector. The actuation lever can be however provided with a foot pedal or the like, ensuring for faultless hygienic conditions even when employing the equipment in public toilets or other washrooms used by many different people. The actuation lever may possess a cable or other traction element or equivalent structure connected with the foot pedal. With this design there is realized a convenient mounting and handling of the apparatus and likewise can be provided for use in washrooms or the like which are heavily frequented by individuals.

The actuation lever can contain a pneumatic or hydraulic or electromagnetic tensioning device, which, in turn, affords a still greater operating comfort.

It is also possible for the lather producing apparatus to contain at least one thermostatic and/or electro-optical and/or electrical heating body which is electromechanically controlled by the actuation lever. With this construction the equipment can be outstandingly employed in barber shops and other hairstyling establishments and so forth. By preheating the liquid soap and/or the infed air it is possible to optimumly heat the lather.

It is possible to guide through the supply container or reservoir an infeed line of a hot water tap location. This provides advantages in terms of energy saving. A further design, advantageous from the standpoint of saving energy, is to construct the infeed line as a heat exchanger.

Moreover, the lather producing apparatus can be provided with at least one electrical throughflow heater. With this construction there is obtained the further advantage that the apparatus can be additionally adapted to the momentary field of application.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
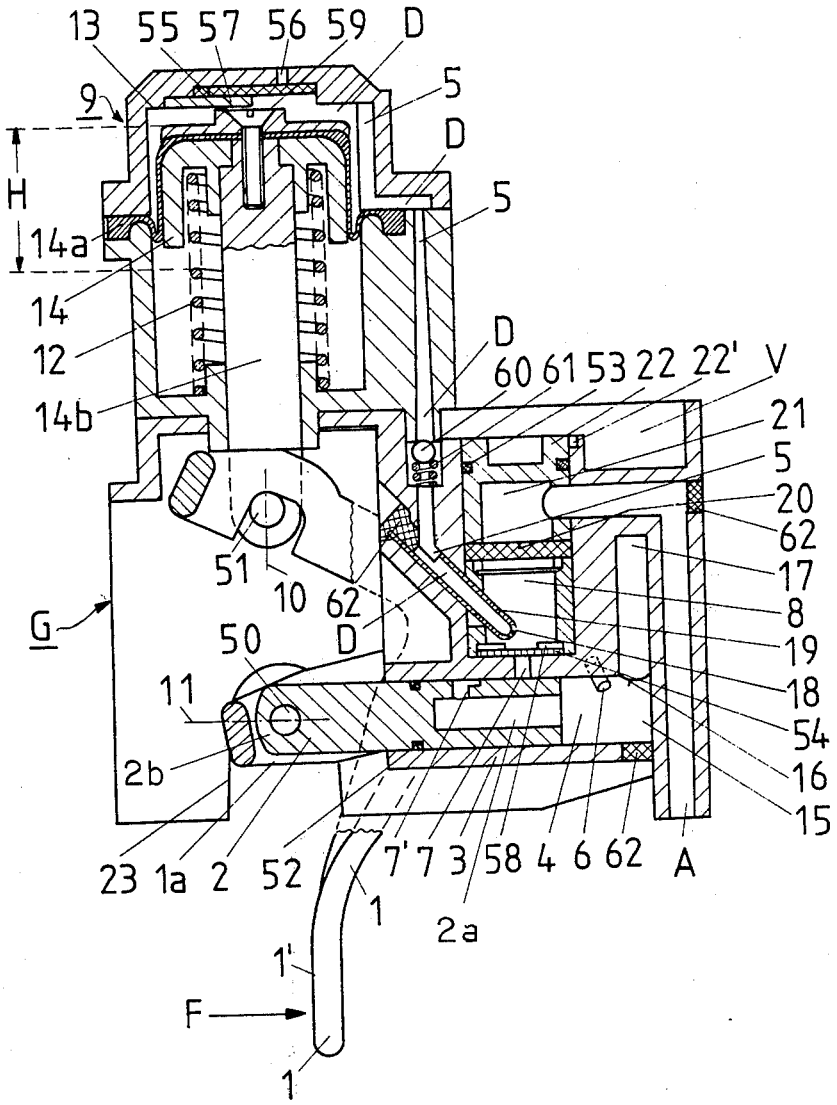
FIG. 1 illustrates a preferred embodiment of a lather dispenser in sectional view.

Describing now the drawings, in FIG. 1 reference character G designates the housing of a lather or soap foam dispenser according to a first embodiment of the invention. Protruding out of the housing G is an actuation lever 1 containing a handgrip 1'. Arranged above the housing G is a supply container or reservoir V, filled with an aqueous soap solution, also referred to herein as liquid soap, the lower portion of which extends into the housing G and is connected by means of chamber-like further lateral supply containers or pockets (one such pocket being shown in FIG. 5) and an infeed means 6 with a cylinder chamber or compartment 4 of a liquid soap-dosing pump 3. Within the liquid soap-dosing pump 3 there is arranged a piston 2 provided with a substantially cylindrical blind hole bore 2*a* and a piston outlet opening 7'. This piston or piston member 2 is designed as a slide-out element and is sealed at one end by means of a suitable sealing O-ring 52. Inserted through the end portion 2*b* of the piston 2 is a bearing pin 50 or equivalent structure which is frictionally or force-lockingly inserted at both of its ends into a drive bracket 1*a* or equivalent structure. The cylinder chamber or compartment 4 is connected by means of a connection opening 7 with a mixing chamber or compartment 8. Protruding into the lower portion of the mixing chamber or compartment 8 is an end of a line or conduit 18, through which flows pressurized air D by means of a pressurized or compressed air line 5 and can efflux via the openings or apertures 19.

The pressurized or compressed air is produced within a membrane or diaphragm pump 9, through appropriate actuation of the operating or actuation lever 1 by application of a force F thereat by the user. The cylinder 13 of this membrane pump 9 possesses a membrane or diaphragm 14*a* formed of rubber, which is guided by a membrane piston 14. The membrane or diaphragm 14*a* is centred by a threaded membrane holder 59 upon the membrane piston 14. A return or restoring spring 12 is placed about a piston rod 14*b* and urges the membrane piston 14 and also the therewith connected actuation elements into the illustrated upper position.

The membrane piston 14 can move through a maximum stroke H, here shown to be in the downward direction, and thus sucks in air by means of an air inlet or opening 56 and a flap valve 55 into the cylinder 13. The flap valve 55 is formed of, for instance, rubber and is fixed at one end, by means of a holder 57, at the cover or top of the cylinder 13.

Now if the operator no longer activates the actuation lever 1, i.e. there is no longer effectual the applied force F, then the membrane piston 14 moves relatively rapidly, under the action of its restoring spring 12, into the upper illustrated position. As a result, the flap valve 55 is closed and there is produced a quantity of pressurized or compressed air D, which acts by means of the compressed air-line or conduit 5, formed of connection channels, upon a ball or spherical element 60 which is pre-biased by a valve spring 61 and allows the pressurized air D to flow by means of the perforated conduit 18 and its holes or apertures 19 into the mixing chamber or compartment 8.

In the illustrated rest position the cylinder chamber or compartment 4 is filled with liquid soap, with the exception of a small, defined dead-space chamber or area 15, which essentially is defined by a blind hole space or chamber 16. If the actuation lever 1 is activated, then the slide-like piston 2 moves up to the end of the cylinder chamber or compartment 4, and thus, produces an air cushion 17 by means of the air located in the deadspace area 15 and the blind hole space or chamber 16. Consequently, the liquid soap is now placed under pressure and such, in the terminal position of the piston 2, is forced through the piston outlet opening 7', the connection opening 7 and the flap valve 54 which is now consequently opened into the mixing chamber 8.

Now the compressed air D flows, in the described manner, into the mixing chamber 8 and, at that location, produces a coarse bubble lather or foam. This coarse bubble lather or foam is pressed through a porous body member 20, a so-called frit or sintered body, and flows through a subsequently arranged expansion chamber 21 into a foam deflection body 22 and finally through an outlet opening A and then is available at that location in the form of a fine, walnut-size lather or soap foam for cleaning purposes or otherwise.

In the embodiment under discussion the axes 10 and 11 of the pistons 14 and 2 are arranged perpendicular with respect to one another. The force transmission from the actuation lever 1, which is designed for instance as a double-arm lever, is accomplished by means of the bearing pins 50 and 51 to a drive bracket 1*a* and to the piston rod 14*b*, respectively.

Moreover, from the illustration of FIG. 1 there are provided closure elements 62 for closing the assembly bores and a recess 23 which is used for assembly purposes. Additionally, the foam deflection body 22 possesses a centering nose 22' as well as an O-ring seal 53. The flap valve 54 or equivalent structure may be advantageously formed of a synthetic rubber and can be centered at its edge by a partially encircling holder ring 58 or the like.

All of the components or parts are fabricated of commercially available materials. As the porous body or body member 20 there has been found to be suitable a frit formed of PTFE (polytetrafluoroethylene). The membrane or diaphragm 14*a* is preferably a so-called rolling membrane, devoid of any fabric, formed on the basis of acrylonitrile-butadiene-caoutchouc, for instance available from the German firm Carl Freudenberg, located at Reichelheim, West Germany.

Throughout the description of the remaining Figures of the drawings there have been conveniently used the same reference characters to denote the same or analogous components.

Figure 2:
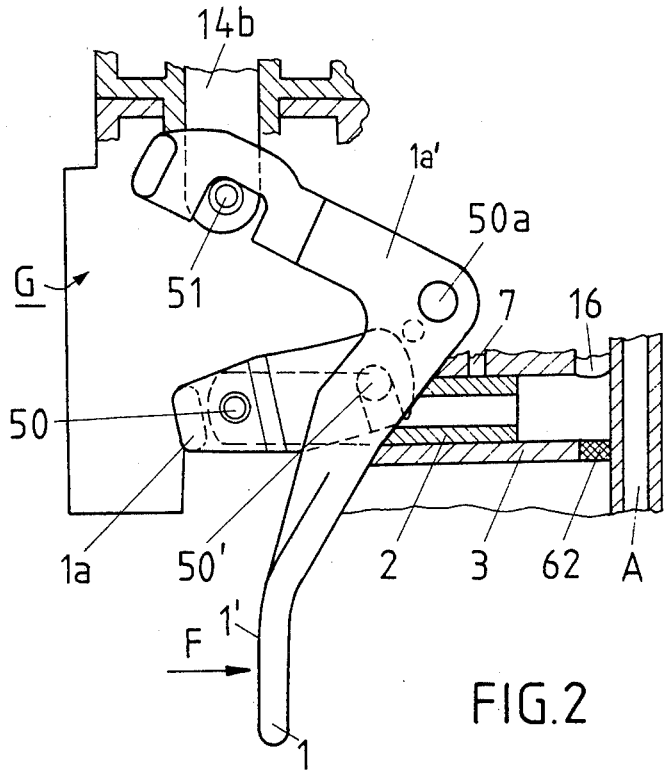
FIG. 2 is an illustration showing details of the activation mechanism of the apparatus of FIG. 1.

Now in FIG. 2 there is shown a fragmentary sectional view which discloses in detail the actuation mechanism and its individual elements. The actuation lever 1, as mentioned, is a double-arm lever and is provided at the outside of its angled or flexed portion 1*a'* with a respective bearing pin 50*a*, whereas there is mounted internally of such actuation lever 1, within a recess 1'' shown in FIG. 2*a*, a drive bracket 1*a* by means of two further respective pins 50'. Extending through the drive bracket 1*a* is a bearing pin 50, by means of which it is possible to transmit forces to the piston 2.

As will be apparent from the drawings, an actuation force F results in a rotational movement of the actuation lever 1 through a certain arcuate extent, and thus, draws the membrane piston 14, not particularly shown in FIG. 2, downwardly by means of its piston rod 14*b* and the bearing pin 51 which piercingly extends through such piston rod 14*b*. At the same time, through the action of an appreciably lesser force, transmitted by means of the pin 50' and the drive bracket 1*a* and the further bearing pin 50 to the piston 2, this piston or piston member 2 is brought into its front terminal position.

Figure 2A:
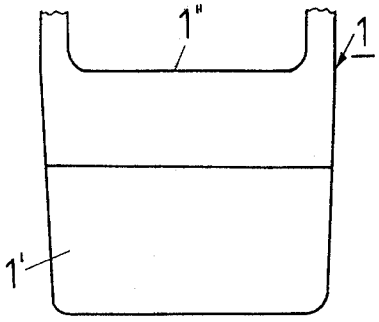
FIG. 2*a* illustrates the handgrip of the actuation lever of the arrangement of FIGS. 1 and 2.

In FIG. 2*a* there will be additionally apparent the actuation surface 1', which is structured for manual actuation of the actuation lever 1.

Figure 3:
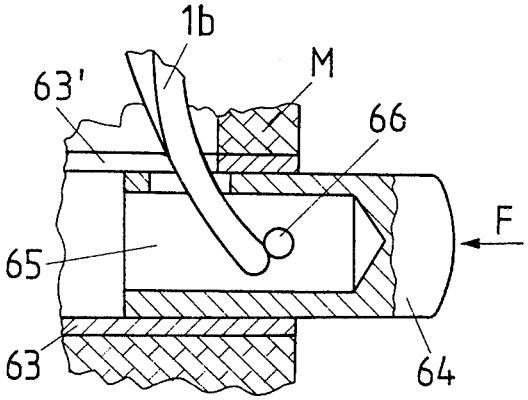
FIG. 3 is a variant embodiment of actuation lever for foot acutation.

Continuing, in FIG. 3 there is illustrated an actuation lever 1*b* which leads to a not particularly here illustrated lather dispenser or apparatus which is mounted at a wall, and in relation to the showing of FIGS. 1, 2 and 2*a*, is longer and narrower and extends through a brickwork M. In the brickwork M there is embedded a guide bushing or sleeve 63. This guide bushing 63 possesses a slot 63' for the actuation lever 1*b* and internally thereof there is arranged to be slidable a pin 64 which is domed or arched at one side. The pin 64 possesses a blind hole bore 65 into which extends the end of the actuation lever 1*b* and through which piercingly extends a rotatable pin 66. Now if a force F is applied in the illustrated manner to the pin 64, then the actuation lever 1*b* is operable in the above-described manner. The return of the actuation lever 1*b* and the pin 64 is accomplished, also in this case, by the previously described return or restoring spring 12.

This variant embodiment of lather producing apparatus has the advantage that it is capable of being actuated at a location remote from the actual apparatus or dispenser. It is particularly suitable for a hygienic faultless foot actuation.

Figure 4:
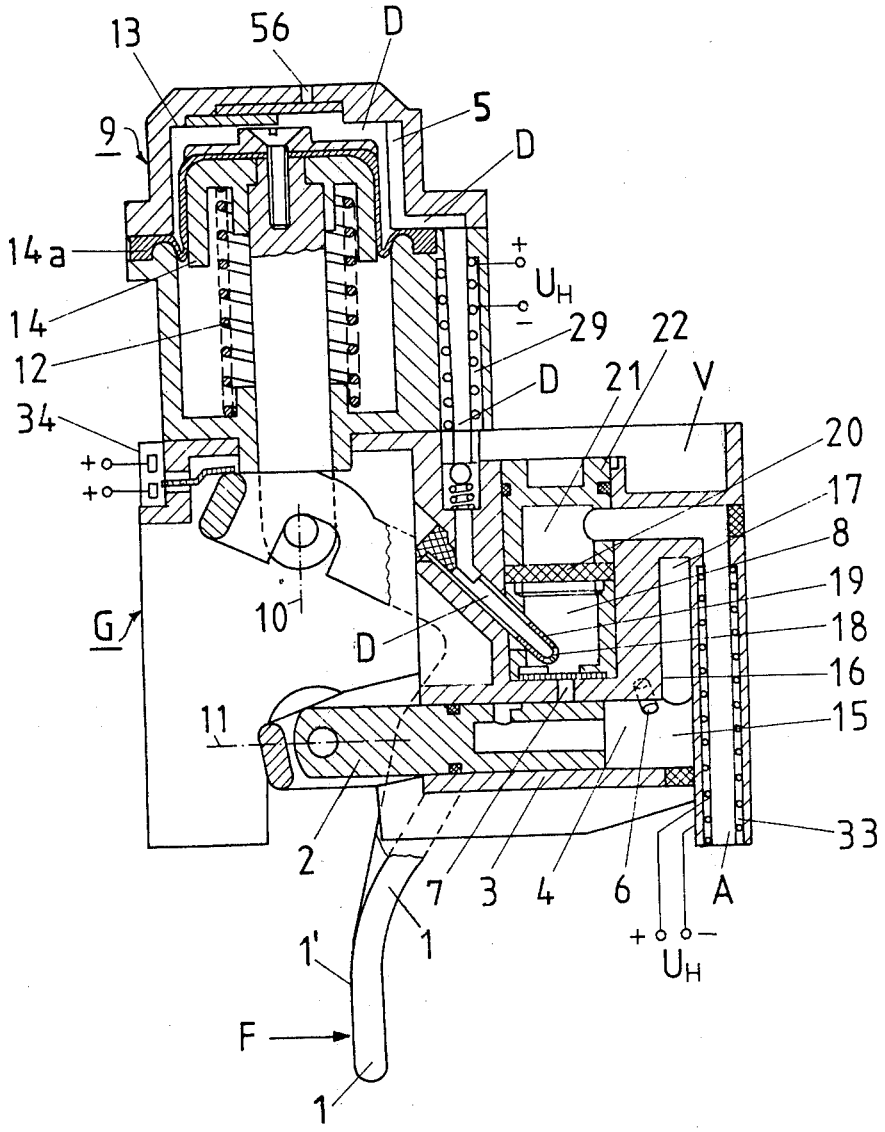
FIG. 4 illustrates an apparatus for forming hot lather or soap foam employing an electrical heater for preheating the air and an electrical throughflow heater for the lather.

With the embodiment of lather producing apparatus as shown in FIG. 4 there are integrated therein two heaters or heating devices 29 and 33, which will be discussed more fully hereinafter, serving to form hot lather and predominantly being employed for shaving purposes.

More specifically, a heating element or body 29 is arranged in the pressurized air-line or conduit 5 and therefore heats-up the throughflowing pressurized or compressed air D before it enters the mixing chamber or compartment 8. As a second variant there may be provided a throughflow heater 33 which heats-up the outflowing lather.

Preferably, the heating body 29 and the throughflow heater 33 can be operated with a heating potential or voltage UH in the order of twelve to twenty-four volts which is not dangerous to the user. In order to turn on such voltage UH at the proper point in time there is provided a suitable switch, here shown as a microswitch 34. In FIG. 4 the microswitch 34 is shown in its switched-off position and its operation is determined by the upper end of the actuation lever 1.

The connection terminals conveniently designated by the positive (+) and the negative (−) signs, of course, also can be operated with an alternating current voltage and powered by means of thermostatic or electronic switches and time-delay elements. Instead of using electromechanical switching elements it would also be possible to employ electro-optical switching elements, such as conventional light barriers. Moreover, the heating means can be turned-on and/or turned-off by relays by activating a room lighting system or room ventilation system.

The heating body or heater 29 has been found to be particularly advantageous for the preheating of the air, since such is present in the lather in an amount by volume which is approximately 15-fold greater than the liquid soap.

Figure 5:
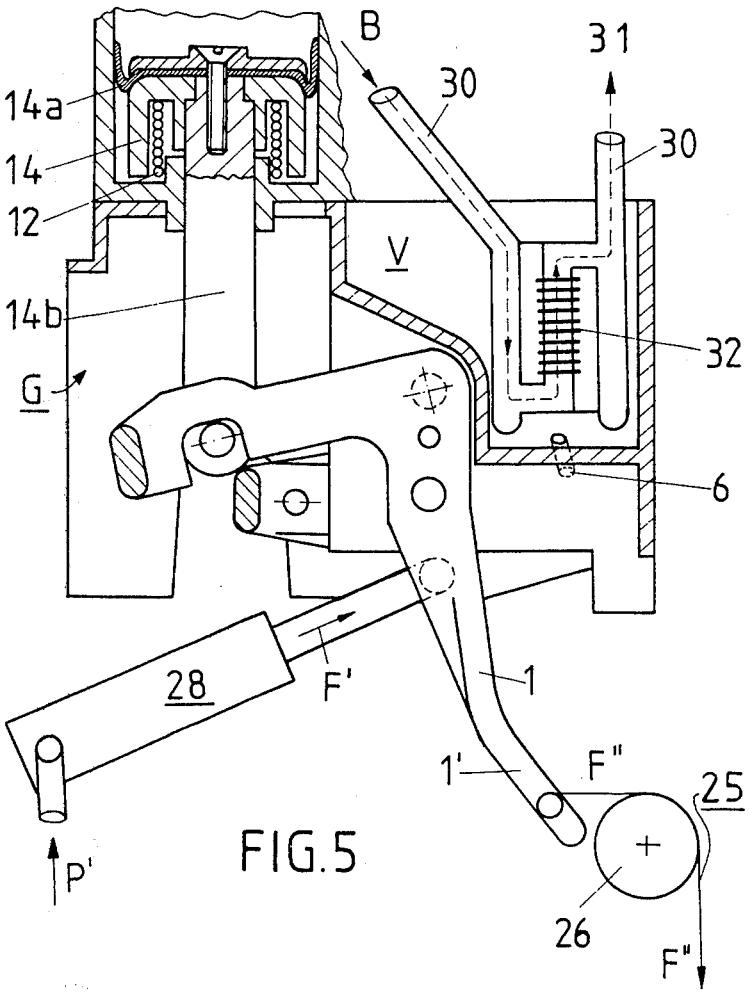
FIG. 5 illustrates a further variant construction of lather producing apparatus having a hot water-heat exchanger in the liquid soap-supply container or reservoir.

A further variant embodiment for preheating the liquid soap has been shown in FIG. 5. The chamber-like structured supply container or reservoir V at both side surfaces of the housing G contains an infeed line or infeed means 30, or a bypass leading therefrom, which infeed line 30 leads from a hot water source B, for instance a boiler, to a hot water tap location 31, a water or mixing tap. In order to improve the transfer of heat to the liquid soap there is provided a lamella-like heat-exchanger 32 which is mounted upon the infeed means 30.

Moreover, in FIG. 5 there have been symbolically illustrated different types of drive mechanisms for a foot actuation of the actuation lever 1. An activation or tensioning device 28, which may be pneumatic, hydraulic, electrical or electromechanical in nature, is arranged at an inclination such that its maximum force F', in the one terminal position of the lever 1, where the restoring spring 12 is tensioned, develops a maximum torque or rotational moment.

As a further possibility there has been shown at the lower end region of the lever 1 the use of a traction cable 25 equipped with a deflection roll 26.

Figure 5A:
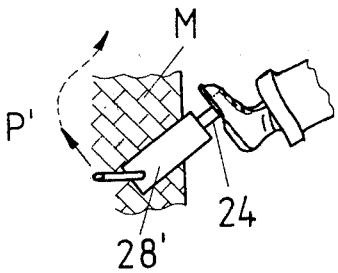
FIGS. 5*a* and 5*b* illustrate two possibilities of foot actuating the lather producing apparatus of FIG. 5.

A practical exemplary embodiment used in conjunction with an actuation or tensioning device 28, responsive to the application of a force or pressure P', has been illustrated in FIG. 5*a*. Here a hydraulic cylinder 28' having a foot actuator or pedal 24 is embedded into a brickwork or structure M and produces the pressure P' needed for the actuation of the tensioning device 28.

Figure 5B:
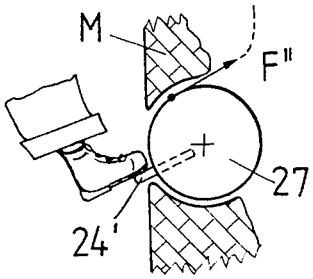

As an alternative to this arrangement there has been shown in FIG. 5*b* to a roller or roll 27 which is mounted in a brickwork or structure M. The roller 27 can be rotated by a further foot pedal or actuator 24' and produces, by means of the tension or traction cable 25, the force F'' in the traction cable 25 which is needed for the actuation of the actuation lever 1.

All of the herein disclosed embodiments have low spatial requirements and can be integrated into the housings of conventional soap dispensers or combined therewith. The molded parts of the apparatus ar advantageously fabricated by injection molding from duroplast (commercially available thermosetting plastics).

In order to reduce the force F which must be applied at the actuation lever 1, it would be possible to pre-bias or pressurize the compressed air also by other pneumatic means, such as through the use of $CO_2$-cartridges, small rotating compressors and so forth.

By means of the invention it is possible to provide hygienically faultless washing and shaving possibilities and in a most economical manner. Additionally, in contrast to the heretofore known lather producing equipment, with the inventive constructions the consumption of soap or liquid soap is appreciably reduced because of the high proportion of air in the produced lather, so that, on the one hand, the waste water is polluted to a lesser degree and, on the other hand, there does not escape into the atmosphere any propellant gas which destroys ozone.

While there are shown and described present preferred embodiments of the invention, it is to be distinctly understood that the invention is not limited thereto, but may be otherwise variously embodied and practised within the scope of the following claims. Accordingly,

What I claim is:

1. An apparatus for forming lather comprising:

a liquid soap-dosing means;

an actuation lever for actuating said liquid soap-dosing means;

means provided for said liquid soap-dosing means for providing a source of pressurized fluid medium;

means defining a mixing chamber;

means communicating said source of pressurized fluid medium with said mixing chamber;

at least one supply container for liquid soap;

said liquid soap-dosing means comprising a liquid soap-dosing pump;

said liquid soap-dosing pump containing a cylinder compartment and a piston arranged within said cylinder compartment;

said actuation lever simultaneously serving for driving the piston arranged in said cylinder compartment of said liquid soap-dosing pump and for the compression and infeed of the pressurized fluid medium;

infeed means for the infeed of the liquid soap to the cylinder compartment;

means defining a connection opening between the cylinder compartment and the mixing chamber; and said piston being structured as a slide element for closing and opening said infeed means and for closing and opening said connection opening between said cylinder compartment and said mixing chamber.

2. The apparatus as defined in claim 1, wherein:

said means providing a source of pressurized fluid medium comprises a membrane pump.

3. The apparatus as defined in claim 2, wherein:

said membrane pump has an axis disposed essentially perpendicular to the axis of the piston or a line parallel to the axis of the piston of the liquid soap-dosing pump.

4. The apparatus as defined in claim 3, further including:

return spring means provided for said membrane pump.

5. The apparatus as defined in claim 3, wherein:

said membrane pump comprises a cylinder and a membrane piston coacting therewith; and the dimension of said cylinder and the stroke of said membrane piston being dimensioned in relation to a predetermined dosing volume.

6. The apparatus as defined in claim 1, wherein:

said cylinder compartment contains a dead space possessing a blindhole region for an air cushion.

7. The apparatus as defined in claim 1, wherein:

said communicating means includes inlet means opening into a lower portion of the mixing chamber.

8. The apparatus as defined in claim 7, wherein:

said inlet means comprises wall means which contain perforations.

9. The apparatus as defined in claim 7, further including:

a porous body arranged between said mixing chamber and an outlet opening for the lather.

10. The apparatus as defined in claim 9, further including:

means defining an expansion chamber provided between said porous body and the outlet opening.

11. The apparatus as defined in claim 10, further including:

an exchangeable lather deflection body containing said expansion chamber.

12. An apparatus for forming lather comprising:

a liquid soap-dosing means;

an actuation lever for actuating said liquid soap-dosing means;

means provided for said liquid soap-dosing means for providing a source of pressurized fluid medium;

means defining a mixing chamber;

means communicating said source of pressurized fluid medium with said mixing chamber;

at least one supply container for liquid soap;

said liquid soap-dosing means comprising a liquid soap-dosing pump;

said liquid soap-dosing pump containing a cylinder compartment and a piston arranged within said cylinder compartment;

said actuation lever simultaneously serving for driving the piston arranged in said cylinder compartment of said liquid soap-dosing pump and for the compression and infeed of the pressurized fluid medium;

said means providing a source of pressurized fluid medium comprises a membrane pump; and said actuation lever comprises a double-arm lever.

13. The apparatus as defined in claim 12, wherein:

the double-arm lever has a first lever arm and a second lever arm, wherein the first lever arm serves for the actuation of the membrane pump which is equipped with spring means; and said first lever arm being longer than the second lever arm which serves for the drive of the piston of the liquid soap-dosing pump.

14. The apparatus as defined in claim 12, wherein:

said actuation lever is provided with handgrip means.

15. The apparatus as defined in claim 12, wherein:

said actuation lever is provided with foot actuation means.

16. The apparatus as defined in claim 12, wherein:

said actuation lever is provided with traction cable means; and said traction cable means being connected with foot operated means.

17. The apparatus as defined in claim 12, further including:

a tensioning device provided for said actuation lever.

18. An apparatus for forming lather comprising:

a liquid soap-dosing means;

an actuation lever for actuating said liquid soap-dosing means;

means provided for said liquid soap-dosing means for providing a source of pressurized fluid medium;

means defining a mixing chamber;

means communicating said source of pressurized fluid medium with said mixing chamber;

at least one supply container for liquid soap;

said liquid soap-dosing means comprising a liquid soap-dosing pump;

said liquid soap-dosing pump containing a cylinder compartment and a piston arranged within said cylinder compartment;

said actuation lever simultaneously serving for driving the piston arranged in said cylinder compartment of said liquid soap-dosing pump and for the compression and infeed of the pressurized fluid medium;

heater means for forming a hot lather; and infeed line means leading from a hot water tap through the supply container.

19. The apparatus as defined in claim 18, wherein:

said infeed line means is structured to define heat exchanger means.

20. An apparatus for forming lather comprising:

a liquid soap-dosing means;

an actuation lever for actuating said liquid soap-dosing means;

means provided for said liquid soap-dosing means for providing a source of pressurized fluid medium;

means defining a mixing chamber;

means communicating said source of pressurized fluid medium with said mixing chamber;

at least one supply container for liquid soap;

said liquid soap-dosing means comprising a liquid soap-dosing pump;

said liquid soap-dosing pump containing a cylinder compartment and a piston arranged within said cylinder compartment;

said actuation lever simultaneously serving for driving the piston arranged in said cylinder compartment of said liquid soap-dosing pump and for the compression and infeed of the pressurized fluid medium;

heater means for forming a hot lather;

infeed means for the infeed of the liquid soap to the cylinder compartment;

means defining a connection opening between the cylinder compartment and the mixing chamber; and said piston being structured as a slide element for closing and opening said infeed means and for closing and opening said connection opening between said cylinder compartment and said mixing chamber.

21. The apparatus as defined in claim 20, wherein:

said means defining a source of pressurized fluid medium comprises a membrane pump.

22. The apparatus as defined in claim 21, wherein:

said membrane pump has an axis disposed essentially perpendicular to the axis of the piston or a line parallel to the axis of the piston of the liquid soap-dosing pump.

23. The apparatus as defined in claim 22, further including:

return spring means provided for said membrane pump.

24. The apparatus as defined in claim 22, wherein:

said membrane pump comprises a cylinder and a membrane piston coacting therewith; and the dimension of said cylinder and the stroke of said membrane piston being dimensioned in relation to a predetermined dosing volume.

25. An apparatus for forming lather comprising:

a liquid soap-dosing means;

an actuation lever for actuating said liquid soap-dosing means;

means provided for said liquid soap-dosing means for providing a source of pressurized fluid medium;

means defining a mixing chamber;

means communicating said source of pressurized fluid medium with said mixing chamber; at least one supply container for liquid soap;

said liquid soap-dosing means comprising a liquid soap-dosing pump;

said liquid soap-dosing pump containing a cylinder compartment and a piston arranged within said cylinder compartment;

said actuation lever simultaneously serving for driving the piston arranged in said cylinder compartment of said liquid soap-dosing pump and for the compression and infeed of the pressurized fluid medium;

heater means for forming a hot lather;

said actuation lever comprises a double-arm lever; the double-arm lever has a first lever arm and a second lever arm, wherein the first lever arm serves for the actuation of a membrane pump which is equipped with spring means;

said means providing a source of pressurized fluid medium comprises said membrane pump; and said first lever arm being longer than the second lever arm which serves for the drive of the piston of the liquid soap-dosing pump.

* * * * *